US008186090B1

(12) United States Patent
Chiarolanza et al.

(10) Patent No.: US 8,186,090 B1
(45) Date of Patent: May 29, 2012

(54) ADJUSTABLE BUTTSTOCK ASSEMBLY

(75) Inventors: Joseph P. Chiarolanza, Oak Ridge, NJ (US); Kevin T. Bauer, Lakeville, PA (US); Marcos A. Collado, Landing, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 158 days.

(21) Appl. No.: 12/824,570

(22) Filed: Jun. 28, 2010

Related U.S. Application Data

(60) Provisional application No. 61/221,187, filed on Jun. 29, 2009.

(51) Int. Cl.
*F41C 23/14* (2006.01)

(52) U.S. Cl. ..... 42/73

(58) Field of Classification Search ..... 42/71.01, 42/72, 73, 75.03
See application file for complete search history.

(56) References Cited

U.S. PATENT DOCUMENTS 3,348,328 A * 10/1967 Roy ..... 42/73
4,663,877 A * 5/1987 Bragg ..... 42/74
7,162,822 B1 * 1/2007 Heayn et al. ..... 42/73
7,398,616 B1 * 7/2008 Weir ..... 42/73
7,793,453 B1 * 9/2010 Sewell et al. ..... 42/73
7,966,761 B1 * 6/2011 Kuczynko et al. ..... 42/73

* cited by examiner

*Primary Examiner* — Bret Hayes
*Assistant Examiner* — Reginald Tillman, Jr.
(74) *Attorney, Agent, or Firm* — Henry S. Goldfine

(57) ABSTRACT

An adjustable buttstock assembly for a hand carried weapons, wherein an inner stock extends from and slidably moves into an outer stock to provide the length adjustment and where a set of opposed spring loaded engagement pins, located in the end of the inner stock, extend through a set of discrete, opposed openings in the outer stock to securely hold the stocks in position one relative to the other. One of the engagement pins, engages into one of a series of discrete holes located in the lower side of the outer stock, while the other engages into one of a series of partial oval opening, opposed thereto, the series of partial oval openings located on the upper side of the outer stock separated by flat teeth, to form a rack, with each partial oval opening into an open channel running the length of the rack. Such that when the lower engagement pin is compressed into the lower opening in which it may be and the upper engagement pin then rotated out of the partial oval opening into the channel—the inner and outer stocks are then free to move one with respect to the other to extend or compress the adjustable buttstock. Further, the inner stock is fixed to a backplate that engages with the receiver of the weapon, and provides protection for a hydraulic buffer that engages with the receiver of the weapon and extends into the inner stock.

5 Claims, 8 Drawing Sheets

ADJUSTABLE BUTTSTOCK ASSEMBLY

CROSS-REFERENCE TO RELATED APPLICATIONS

This application claims benefit under 35 USC §119(e) of U.S. provisional patent application No. 61/221,187 filed Jun. 29, 2009.

U.S. GOVERNMENT INTEREST

The inventions described herein may be manufactured, used and licensed by or for the U.S. Government for U.S. Government purposes.

FIELD OF THE DISCLOSURE

This disclosure relates generally to infantry light and medium machine guns, and in particular to a light weight, securely adjustable buttstock for such weapons.

BACKGROUND OF THE DISCLOSURE

Weapons such as U.S. M249 Squad Automatic Weapon (SAW), a light machine gun, the M240B, a medium machine gun, as well as, foreign light machine guns, such as the Israeli Negev, and Singaporean Ultimax 100 are all designed to be hand carried into combat, as well as, being fixed position weapons. As carried weapons, these guns weight from 15 to 35 pounds and from 41 to 49 inches in length are unwieldy, to say the least. Therefore, any reduction in weight and length clearly adds to their portability and functionality, especially in combat situations.

A buttstock (or shoulder stock or simply stock) is a part of a rifle or other firearm (personal weapon) that may be held against a shooter's shoulder when firing the weapon. The buttstock provides a means for the shooter to firmly support the weapon and more easily aim it. The buttstock also transmits recoil into the shooter's body when so positioned and the weapon is fired.

Buttstocks on standard rifles, portable machine guns, and other shoulder-fired weapons customarily have stocks with a butt portion located a particular distance from the trigger. That distance is termed "pull length" or "length of pull." The length of pull of most rifles is based on the arm length of a typical user. Problems may arise when the user's size varies from the typical user. With a smaller than typical user, the distance to the trigger is too great when the rifle is braced properly on the shoulder. Variation from correct fit results in increased likelihood of unsafe and inaccurate operation of the weapon.

A light weight, adjustable buttstock for a weapon allows a user to more easily transport and position the weapon; plus having incremental adjustments in the overall length of the weapon help to suit the user's particular "pull length". Further, considering the overall length of light and medium machine guns, a length adjustment is generally necessary when—for example—the weapon is mounted in tight quarters; to provide proper clearance (especially when the user is wearing body armor), thereby allowing the user to comfortably get into position behind the weapon allowing for proper eye relief and to properly site the weapon as needed; to quickly enter and exit a vehicle when transporting the weapon; and for further ease in narrow hallways and doorways. The adjustable buttstock may contain a buffer recoil mechanism to attenuate excessive recoil of the weapon.

A variety of adjustable buttstocks have been developed and are known in the art. Some include adjustable cheek rests (see, e.g., United States Patent Application Publication No. US 2008/0028662—Abraham) while others (see, e.g., U.S. Pat. No. 7,162,822—Heayn) do not (both 2008/0028662 and U.S. Pat. No. 7,162,822 are hereby incorporated herein by reference); however, such prior art solutions do not provide the desired combination of weight, and the secure plus easy means of length adjustment necessary in combat.

SUMMARY OF THE DISCLOSURE

An advance is made in the art according to an aspect of the present disclosure directed to an adjustable buttstock for military weapons, such as light and medium machine guns and the like. However, the present invention may be used on many other shoulder fired weapons of various types, makes and models; therefore, this disclosure should not be construed as a limitation of the present invention to any specific shoulder fired weapon application. Advantageously, the adjustable buttstock of the present disclosure is easily adjustable and importantly, securely adjustable, i.e. it does not suffer from involuntary actuation; includes a removable cheek rest that is low in weight yet rugged; and modular such that a variety of cheek rests may be employed. Further, as the removable cheek rest of the present invention is hollow, it provides a ready storage location for miscellaneous small items—such as batteries; or a sharpened wooden dowel that can be used to clear the weapon; or a small screwdrivers or other tools wrapped in a rag for servicing the weapon, or the like.

The buttstock of the present invention may include a conventional hydraulic cylindrical buffer assembly which is provided with a backplate assembly and latch assembly, to mate to and be secured to the back of the weapon and to dampen the recoil thereof with respect to the user's shoulder—which dampening is critical in the case of any light or medium machine gun upon which the buttstock may be mounted. This cylindrical buffer assembly is housed within a cylindrical inner stock, one end of which cylindrical stock is fastened to the backplate and the other is slidably contained within and extends from a larger diameter cylindrical outer sleeve or stock, which outer stock is secured to a butt plate that rests against the user's shoulder. The present invention provides an inventive, secure means for slidably positioning and then locking the cylindrical inner stock in a plurality of discrete positions along the length of the outer stock—such that the inner stock will extend more or less from the outer stock, thereby lengthening or shortening the overall length of the subject inventive buttstock, i.e. the distance between the backplate and the back of the weapon, and the butt plate and the user's shoulder.

The inventive, secure means for locking the inner and outer stocks in any of the plurality of discrete positions along their relative lengths includes a set of opposed engagement pins, or retaining dents, mounted on each end of a compression spring located within a sleeve held within the butt end of the inner stock. The spring forces the engagement pins into a set of opposed openings within the outer stock, thereby locking the inner and outer stocks into a particular relative position, i.e. locking the inner and outer stocks into a particular extension of the inner stock from the outer stock. The opposed openings in the outer stock are formed of a lower plurality, preferably 4 or 5, discrete holes; and opposed thereto, on the upper side of the outer stock, is a rack having a series of generally partial oval openings spaced between a set of generally flattened teeth, one partial oval opening opposed to each of the lower discrete holes, the partial oval openings opening into an channel that connects the various openings on the upper side and runs the length of the rack. This physical configuration is such, that when the bottom pin is forced back through the bottom hole in which it may be lodged, compressing the compression spring, the inner stock will be free to rotate to the extent that the upper pin can rotate out of the generally partial oval opening, in which it may be, and into the open channel; and, once the upper pin is in that channel, the inner stock can be moved unimpeded relative to the outer stock to the ends of that channel, or, to any discrete position having an opposed bottom hole and upper partial oval opening. To reengage the locking of the inner and outer stocks, the inner stock is rotated back, at any of the discrete points where there are opposed openings, to be locked in that relative position again by the upper and lower pins extending into the bottom hole and opposed partial oval opening—under urging of the compression spring.

Further features and advantages of the present invention will be set forth in, or apparent from, the figures and detailed description of preferred embodiments thereof which follows.

BRIEF DESCRIPTION OF THE DRAWING

A more complete understanding of the present disclosure may be realized by reference to the accompanying drawings, in which like parts have been given like numbers, and wherein.

DETAILED DESCRIPTION

A significant problem in the prior art is involuntary actuation of an adjustable buttstock (e.g. collapsing when it is not supposed to), this problem is mitigated according to the present disclosure as detailed above, as the user must depress a lower engagement or retaining pin or detent back through a hole, located along the lower side of the outer stock, and then rotate the inner stock in relation to the outer stock; thereby, allowing an upper engagement or retaining pin to clear an elongated partial oval groove in a rack located along the upper side of the outer stock. Once clear of this groove, the upper retaining pin will be in a longitudinal channel that runs the length of the rack, such that the upper engagement pin can move freely within the channel longitudinally and will not impede the longitudinal extension or contraction of the inner and outer stocks relative to each other; while the lower engagement pin is held against the inside of the outer stock's body (rotated clear of the holes located along the lower side of the outer stock), such that it also does not impede the subject longitudinal extension and contraction.

As stated above, the adjustable buttstock may be employed on a number of weapons including—without limitation—the M240 medium machine gun, as well as, the M249 SAW, and variants thereof, such as the MK46 and MK48 (both variants used by the U.S. Special Operations Command—USSOCOM). Importantly, on certain variants of adjustable buttstocks, including the subject invention, the buttstock has a backplate that mates with the rear of the receiver of the weapon. In the present invention, a conventional hydraulic buffer assembly is provided that rests against the receiver of the weapon and extends into the inventive buttstock through the backplate—the backplate being held to the receiver of the weapon by a spring latch. It is critical, to protect that buffer assembly, because—without it—the recoil forces will damage the weapon. Therefore, preferably, the inner stock is not directly fixed to the buffer recoil mechanism as in the prior art. Instead, in the present invention, both the buffer assembly and the inner stock are both screwed/fixed directly to the backplate which slides into the rear of the receiver, effectively providing a protective housing around the buffer assembly. When subjected to external forces and/or impact loading, the inner stock will absorb the loading and distribute it to the backplate and then into the receiver of the weapon thereby protecting the buffer assembly in the present invention.

Figure 5:
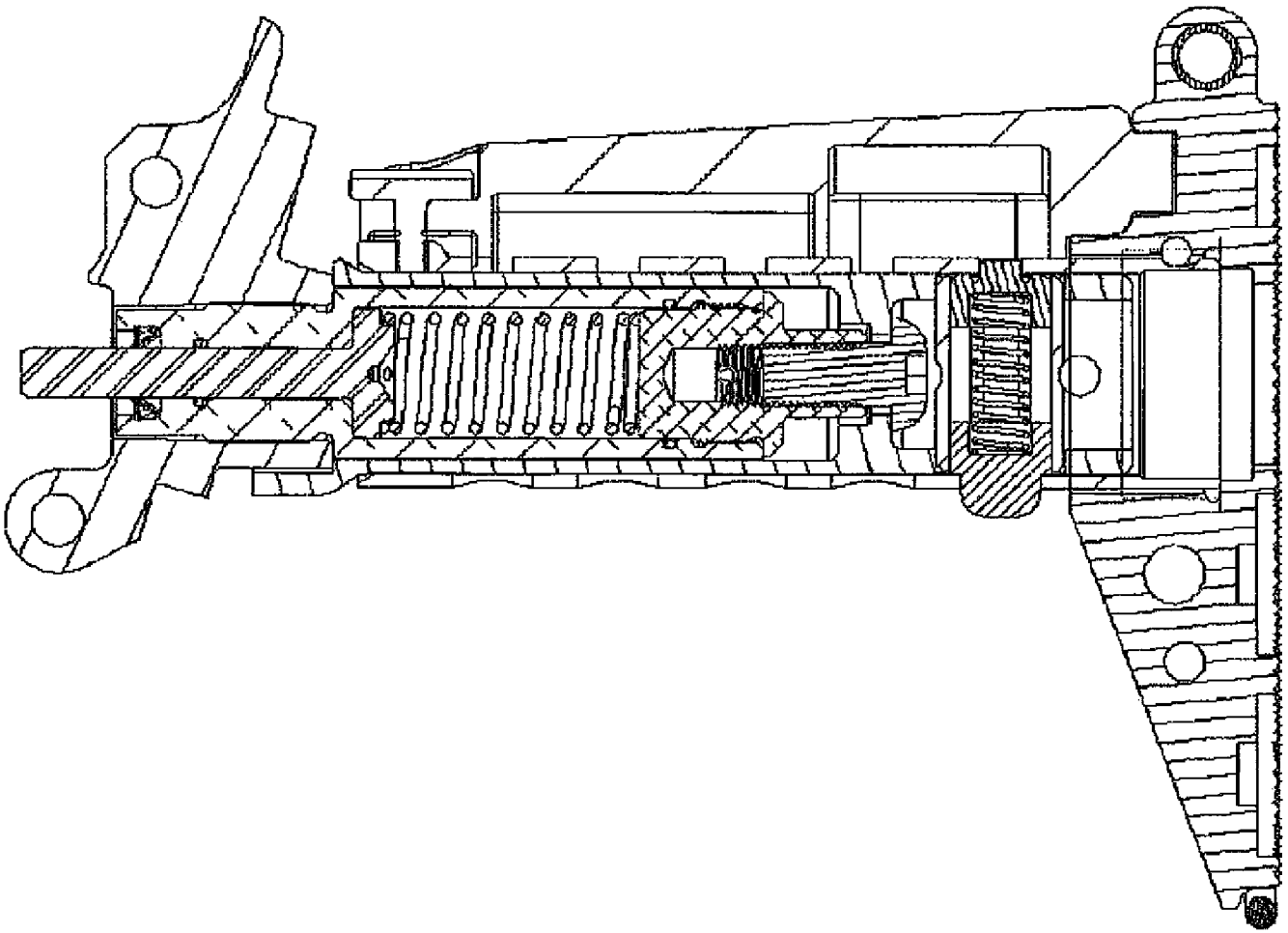
FIG. 5 is a cutaway side view line drawing of an exemplary buttstock according to an aspect of the present disclosure.
Figure 6:
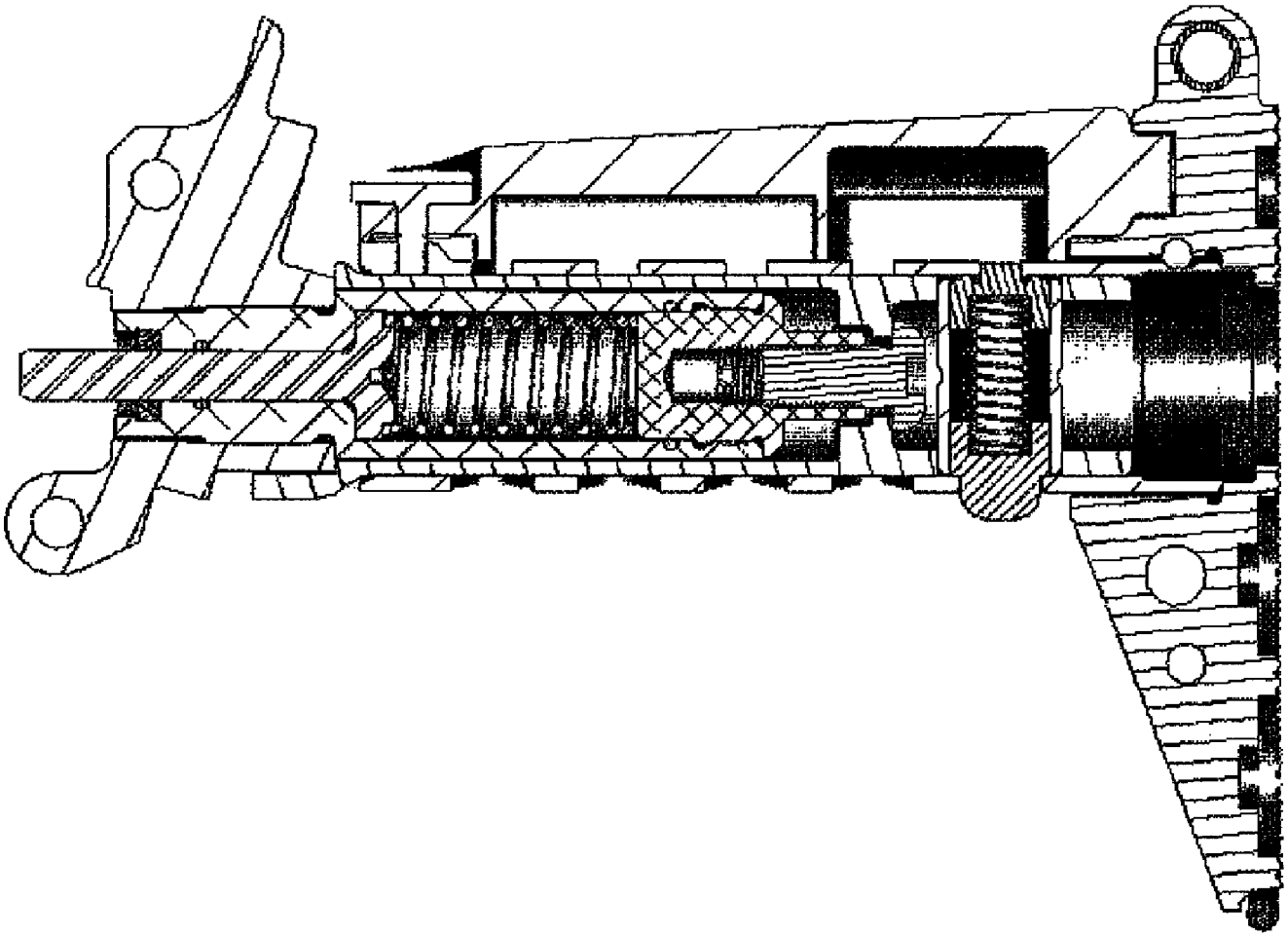
FIG. 6 is another cutaway side view line drawing of an exemplary buttstock according to an aspect of the present disclosure.
Figure 7:
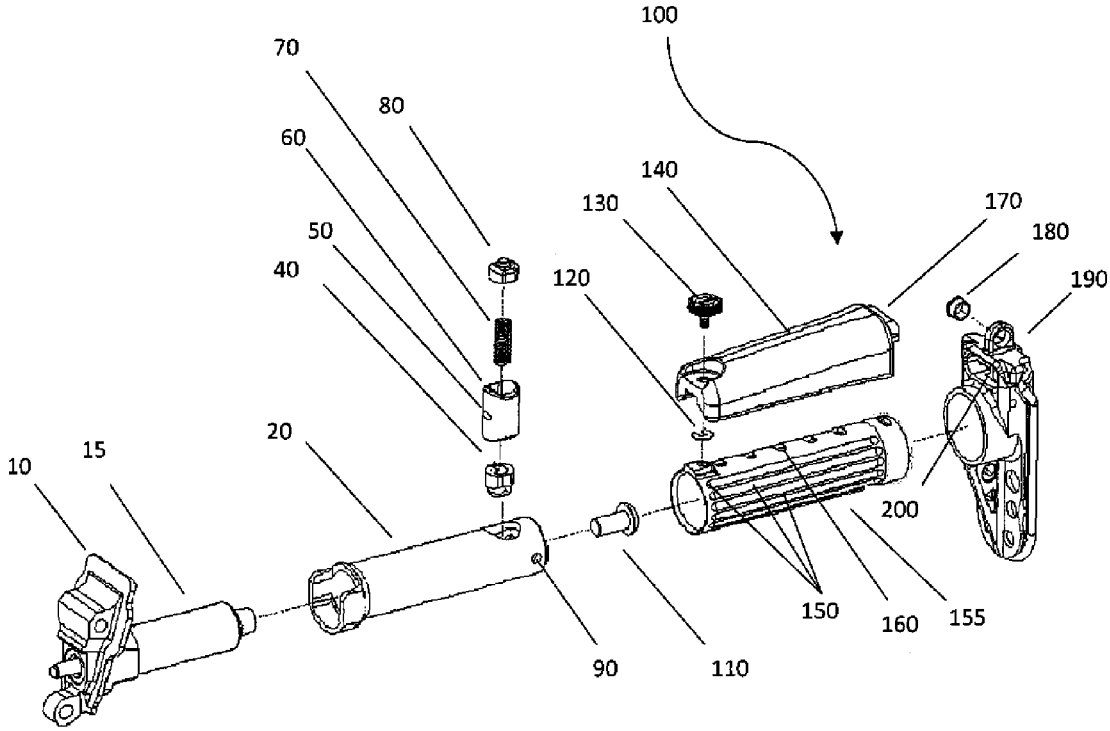
FIG. 7 is an exploded perspective view of an exemplary buttstock according to an aspect of the present disclosure.

Referring to FIG. 7 is a perspective line drawing of a preferred embodiment of the buttstock, 100, of the present invention. As shown element 10 is a backplate designed to interface with a M249 light machine gun, and extending from this backplate is a cylindrical hydraulic buffer, 15. The cylindrical hydraulic buffer, 15, seats within the inner stock, 20, where it is locked in place by a cap screw, 110, which is recessed within the body of the inner stock—such that it does not interfere with the sleeve, 60, which sits in a bore that transverses the inner stock near the butt end thereof—however, if the cylindrical hydraulic buffer, 15, is screwed/secured directly to the backplate, 10, (a most preferred embodiment) the cap screw, 110, is not required. The bore that transverses the inner stock, is aligned with the longitudinal axis of the backplate, 10, which is also aligned with the longitudinal axis of the buttplate, 190—in what can be termed a north-south fashion. The sleeve, 60, contains a stainless steel compression spring, on the top or north side of which is an upper engagement or retaining pin, 80, which upper engagement pin may have a cylindrical button top, and on the bottom or south side is a lower engagement or retaining pin, 40, which lower engagement pin may have a beveled end. The upper, 80, and lower, 40, engagement pins are designed to fit within the sleeve, 60, such that these pins can be compressed together (with the compression spring, 70, in the middle), such that they will be within the diameter of the cylindrical inner stock, 20. With the upper, 80, and lower, 40, engagement pins so compressed, the inner stock, 20, can be slide into the outer stock, 155, as shown in FIGS. 5 and 6. While the inner stock, 20, is slide into the first end of the outer stock, 155, on the second end of the outer stock, 155, is mounted the butt plate, 190.

The sleeve, 60, is held within the transverse bore in the inner stock, 20, by a dowel pin that is held in a small bore, 90, that transverses the inner stock at 90 degrees relative to the transverse sleeve, 60. The sleeve has a set of grooves, 50, one on each side thereof, across which the dowel pin seats, such that when the dowel pin is in place, the sleeve will be held in place. When the inner stock, 20, is held within the outer stock, 155, the dowel pin will be trapped within the small bore, 90, and the upper, 80, and lower, 40, retaining pins, will also be trapped by the outer stock, 155.

Referring to FIG. 7, one can see that a cheek rest, 140, is attached to the top or north side of the outer stock, 155, by a thumb screw, 130, and an e-clip, 120—on the side of the outer stock away from the butt plate, 190. The cheek rest, 140, is secured to the butt plate itself by a tongue, 170, thereon, which tongue, 170, fits into a groove, 200, near the top or north side of the butt plate, 190. The position of the cheek rest, 140, when secured to the outer stock, 155, can clearly been seen in cut-away FIGS. 5 and 6.

Figure 1:
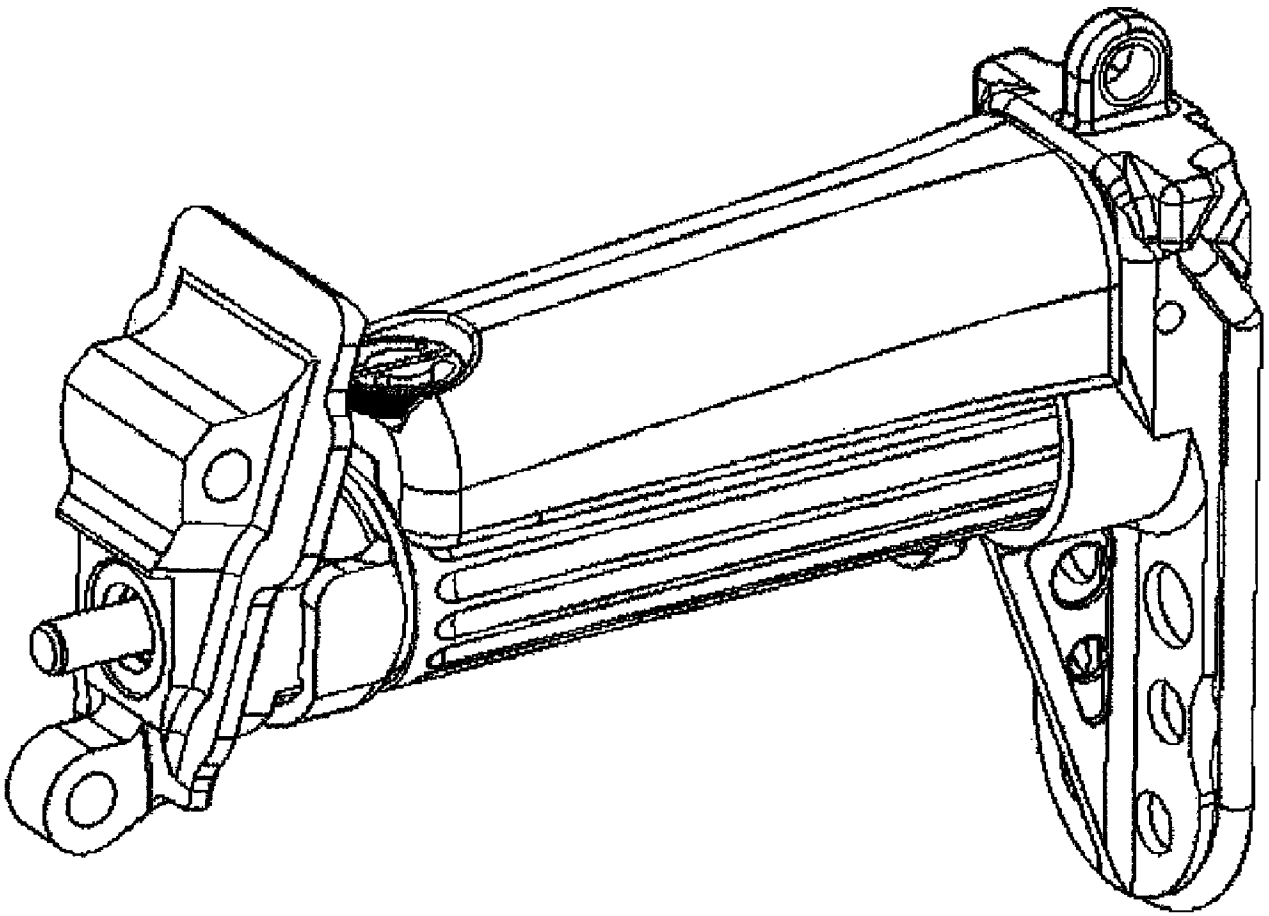
FIG. 1 is a perspective line drawing of an exemplary buttstock with cheekrest according to an aspect of the present disclosure.
Figure 2:
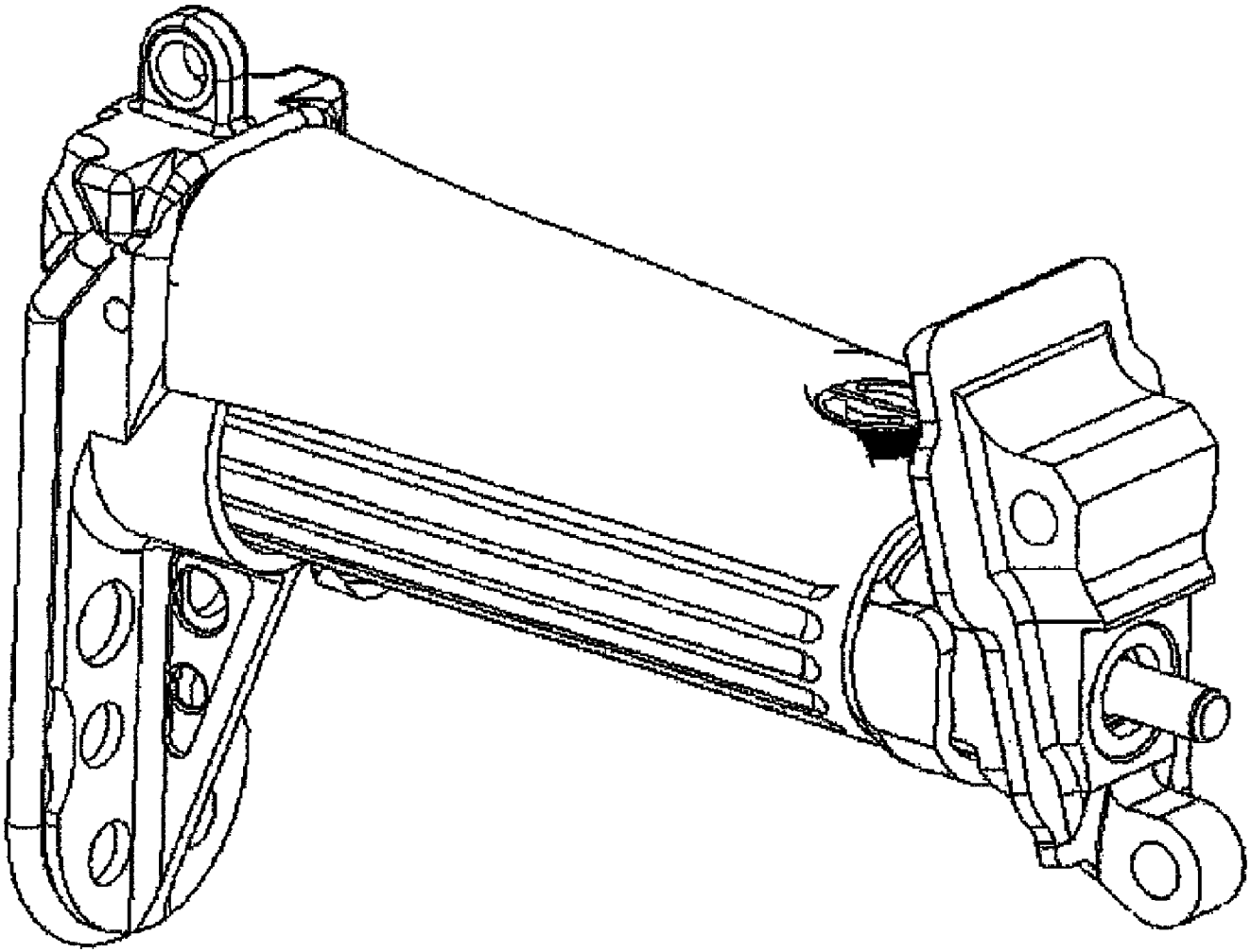
FIG. 2 is another perspective line drawing of an exemplary buttstock with cheekrest according to an aspect of the present disclosure.

Referring to FIGS. 1 and 2, one can observe alternative cheek rests in these two embodiments and as stated above other potential cheek rest configurations can be employed, including concave and padded versions—to provide enhanced ergonomics for the user. Further, all of the shown cheek rests are hollow shells—made of an injection molded plastic or similar material (a preferred such plastic is Dupont Zytel® 8018 Nylon 66). As stated above, while not waterproof, the hollow cheek rests provide convenient storage for the user.

Figure 3:
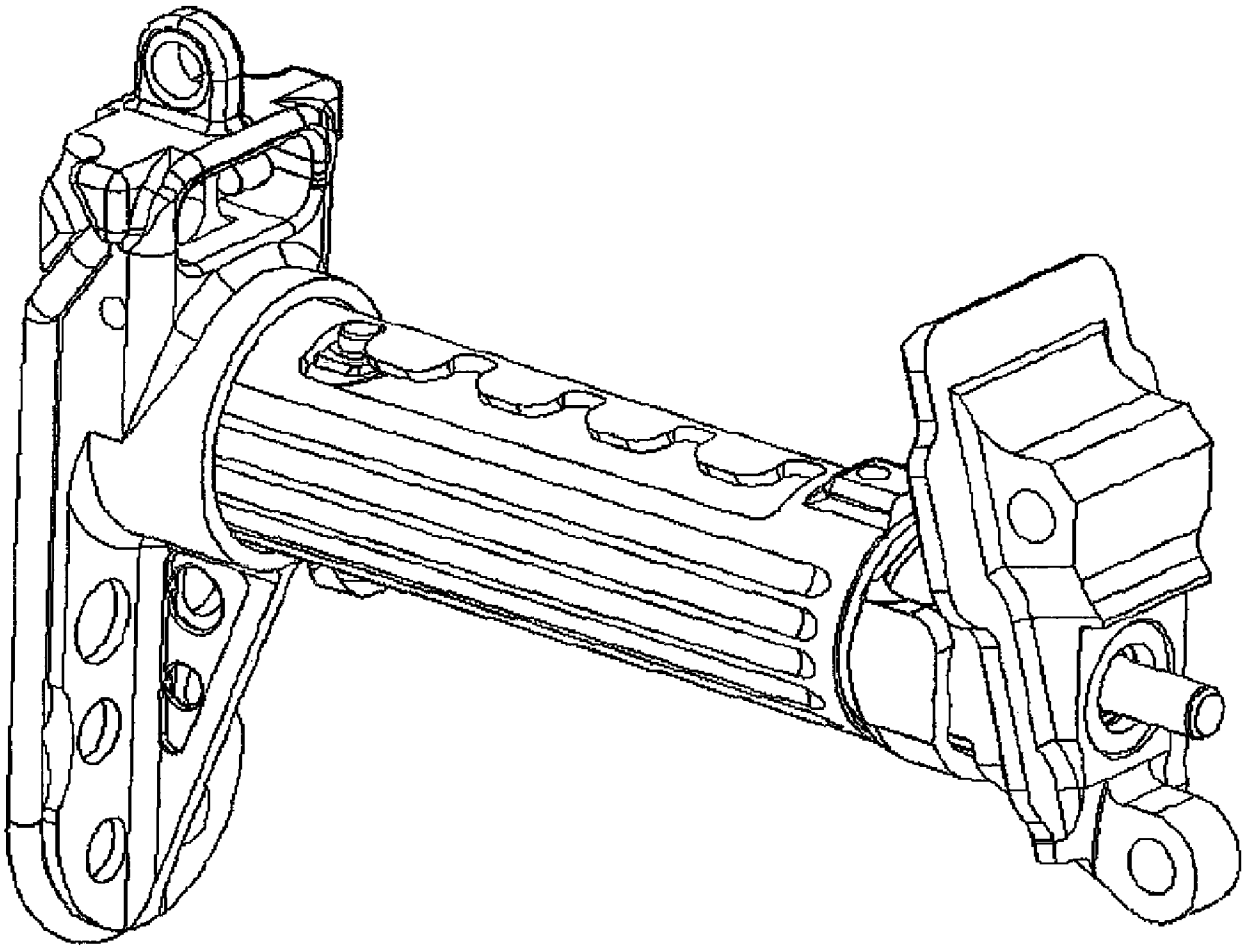
FIG. 3 is a perspective line drawing of an exemplary buttstock with cheekrest removed according to an aspect of the present disclosure.
Figure 4:
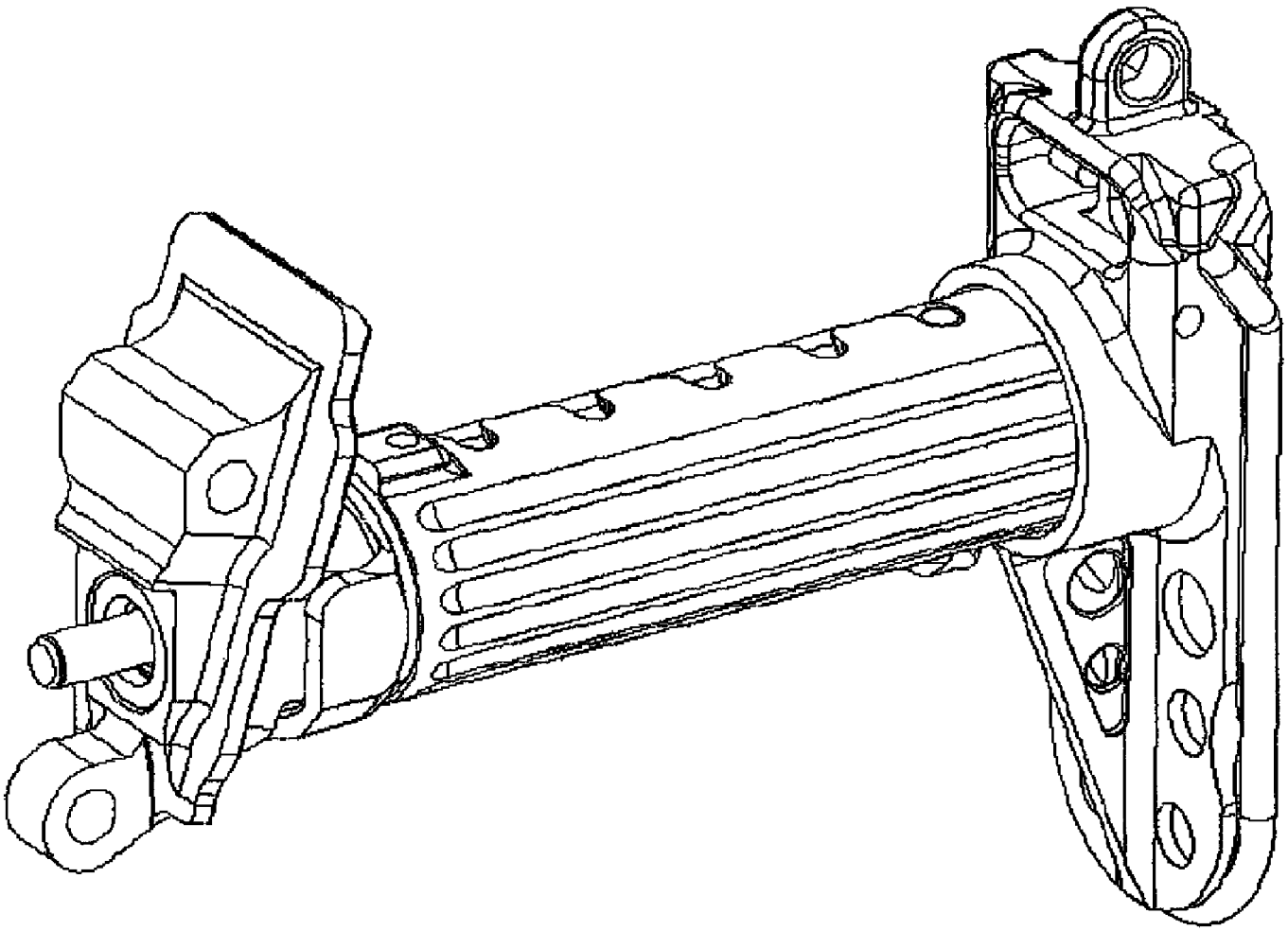
FIG. 4 is another perspective line drawing of an exemplary buttstock with cheekrest removed according to an aspect of the present disclosure.
Figure 8:
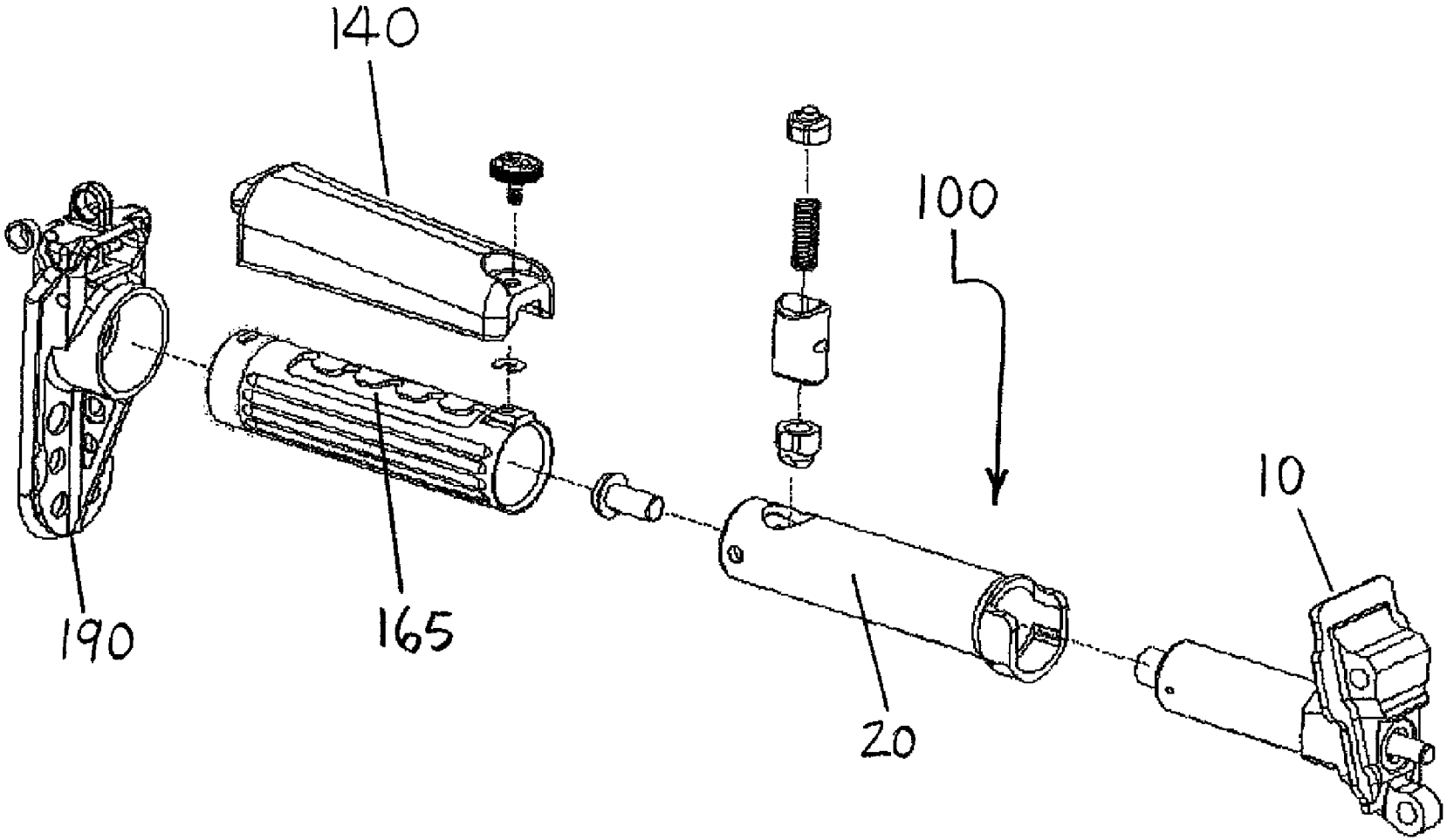
FIG. 8 is another exploded perspective view of an exemplary buttstock according to an aspect of the present disclosure.

FIGS. 3 and 4 clearly shown opposite sides of the upper, or top, or north side of the outer stock, 155, which is also shown in FIGS. 7 and 8, including elements 160 in FIG. 7 (the rack) and 165 in FIG. 8 (the channel). The inner stock is fully enclosed, i.e. withdrawn, into the outer stock in FIGS. 3 and 4, as well as, in FIGS. 5 and 6—where it can be seen that the upper engagement pin is lodged in the partial oval opening in the rack, within the last partial oval opening closest to the butt plate (element 190 in FIG. 7) and in the last lower hole adjacent to the butt plate. Also, it can be clearly seen in FIGS. 3 and 4, that the outer stock is fluted, having a series of parallel longitudinal flutes cut along its length (elements 150 in FIG. 7).

In a preferred embodiment of the subject invention, the inner stock, 20, and butt plate, 190, are manufactured of aluminum to reduce weight. However, the outer stock, 155, is manufactured of 41-40 heat treated steel—as it was found that an aluminum outer stock failed due to the stresses between the lower set of holes. Also manufactured of 41-40 steel, are the engagement pins, 40 and 80, and the sleeve, 60, to ensure the necessary durability and toughness. Further, a sling bushing, 180, is shown in FIG. 7, which is manufactured of low carbon steel.

At this point, while we have discussed and described the invention using some specific examples, those skilled in the art will recognize that our teachings are not so limited. Accordingly, the invention should be only limited by the scope of the claims attached hereto.

The invention claimed is:

1. An adjustable buttstock assembly for a hand carried weapon, comprising:

a backplate and latch assembly which latches to the receiver of the weapon;

a cylindrical inner stock having a first and second end, which first end is fixed to the backplate and latch assembly;

a cylindrical hydraulic buffer having a first end that rests against the back of the weapon, which cylindrical buffer is secured to and passes through the backplate and latch assembly and extends within the inner stock, such that the second end thereof extends generally to the midpoint of the length of the inner stock;

a cylindrical outer stock having a first and second end, which first end of said outer stock slidably accepts therein the second end of the inner stock, and which second end of said outer stock is secured to a buttplate;

a lower engagement pin and an upper engagement pin mounted on the opposed ends of a compression spring located within a sleeve held transversely within the inner stock, near the second end thereof;

the outer stock having a plurality of discrete holes located along the lower side thereof;

the outer stock having a plurality of partial oval openings located along the upper side thereof, which upper partial oval openings are opposed to the discrete holes located along the lower side thereof;

the plurality of upper partial oval openings being separated by generally flattened teeth, to form a rack, where the partial oval openings open into a channel that runs the length of the rack;

wherein, when the inner stock is slidably located within the outer stock, the compression spring will force the lower and upper engagement pins, into the set of opposed lower holes and upper openings, respectively, within the outer stock when the openings and holes are aligned therewith, thereby locking the inner and outer stocks into a particular relative position, one to the other; and whereby, when the lower engagement pin is compressed, compressing the compression spring, such that the lower engagement pin is within the outer stock, and thereby the outer stock is thus free to rotate, and is rotated in relation to the inner stock such that the upper engagement pin moves out of the particular partial oval opening in which it may be, into the channel, whereby by the inner stock can be moved longitudinally unimpeded relative to the outer stock to any discrete position having the opposed lower hole and upper partial oval opening, such that the stocks can be rotated back, in the opposite direction, to reengage the lower and upper engagement pins into a new set of opposed lower hole and upper partial oval opening, to thereby change the relative extension of the inner and outer stocks.

2. The adjustable buttstock assembly for a hand carried weapon of claim 1, further comprising a removable hollow cheekrest, which cheekrest has a first and second end, the first end of which has a tongue extending therefrom, which tongue mates with a groove affixed to the buttplate, and which second end is screwed down to the upper side of the outer stock, thereby providing a cover for the rack.

3. The adjustable buttstock assembly for a hand carried weapon of claim 1, wherein the outer stock has a plurality of parallel flutes along its length.

4. The adjustable buttstock assembly for a hand carried weapon of claim 1, wherein the inner stock is manufactured of aluminum, and the outer stock is manufactured of heat treated steel.

5. The adjustable buttstock assembly for a hand carried weapon of claim 1, wherein the upper engagement pin has a cylindrical button top, and the lower engagement pin has a beveled end.

* * * * *